United States Patent [19]

Braswell

[11] Patent Number: 4,905,375

[45] Date of Patent: Mar. 6, 1990

[54] TOOL FOR EXTRACTING FINGER GRIP INSERT FROM A BOWLING BALL

[76] Inventor: Stephen P. Braswell, 3214 Cathedral La., Jacksonville, Fla. 32211

[21] Appl. No.: 219,238

[22] Filed: Jul. 15, 1988

[51] Int. Cl.[4] ..... B26B 3/00

[52] U.S. Cl. ..... 30/316; 30/301; 30/113.1

[58] Field of Search ..... 30/316, 113.1, 278, 30/301, 316, 340

[56] References Cited

U.S. PATENT DOCUMENTS 2,670,537 3/1954 Campbell ..... 30/316

4,010,543 3/1977 Musbaum ..... 30/316

*Primary Examiner*—Frank T. Yost

*Assistant Examiner*—Willmon Fridie, Jr.

*Attorney, Agent, or Firm*—Arthur G. Yeager

[57] ABSTRACT

A hand operated tool for extracting a finger grip insert glued in a bowling ball including a shaft, a T-shaped handle grip, and a tubular extractor affixed to the shaft and having a knife dull edge free end adapted to cut the insert away from the bowling ball as the tool is turned and pushed inwardly and a beveled inner surface adjacent the free end which applies a funneling force to the insert as the extractor is rotated thereabout whereby cutting of the insert is inhibited.

10 Claims, 2 Drawing Sheets

TOOL FOR EXTRACTING FINGER GRIP INSERT FROM A BOWLING BALL

BACKGROUND OF THE INVENTION

This invention relates to the sport of bowling, sometimes called "ten pins", which is played indoors on wooden alleys with a large plastic ball approximately 10 inches in diameter. Bowling balls are fashioned to be held and thrown by one hand which grips the ball by means of two or three, or more finger holes. One hole is for the thumb, and the other holes for one or more of the other fingers. The most common arrangement is for one thumb hole and two holes for the third and fourth finger, which leaves the index finger and the little finger to rest against the outside of the ball, not in any finger hole.

Dedicated bowlers frequently find that the finger and thumb holes do not provide the exact fit desired for their thumb and fingers, and yet the ball otherwise is entirely satisfactory. Accordingly, there has been developed a means for modifying the fit by drilling the holes slightly larger and then inserting any of several sizes of tubular inserts which provide the exact desired fit. These inserts are usually made of a semiflexible, semicompressible, material which are glued into the holes in the bowling ball. From time to time as fingers swell or contract the fit of a particular insert may become unacceptable and must be replaced. A specialty tool is needed to remove the insert without damage to the bowling ball. In the past, these tools have also cut and materially damaged and/or destroyed the insert. It has now been found that an improvement in the tool can remove the insert without materially damaging or causing destruction of the insert making it suitable for reuse later. Still another improvement is the provision of an air vent which facilitates the removal of the insert from the bowling ball and/or the tool.

It is an object of this invention to provide an improved tool for removing finger grip inserts from bowling balls. It is another object of this invention to provide an improved hand tool that is capable of removing such a finger grip insert in a condition for reuse. Still other objects will become apparent from the more detailed description which follows.

BRIEF SUMMARY OF THE INVENTION

This invention relates to a tool for extracting a finger grip insert in a bowling ball which includes a tool body with a hand grip adapted to turn the body about an axis and an insert extractor extending outwardly from the body along such axis. The extractor is formed of a thin tubular member rigidly connected at one end thereof to said body, and the other end being a free end terminating in a substantially circular dull knife edge. The dull knife edge is sufficiently sharp to cut the glue between the insert and the hole in the bowling ball, but not razor sharp to cause damage to one's hand upon accidental engagement. The dull knife edge is formed by an outside substantially cylindrical surface corresponding to the external surface of the tubular member intersecting with an internal bevelled surface formed between the normal inside diameter spaced from the extreme free edge to a larger diameter adjacent the free edge.

In preferred embodiments of the invention the tool is made of copper pipe assembled in the form of a tee and has an air vent hole through the wall of the tubular member near its connection to the tool body.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENT OF THE INVENTION

Figure 1:
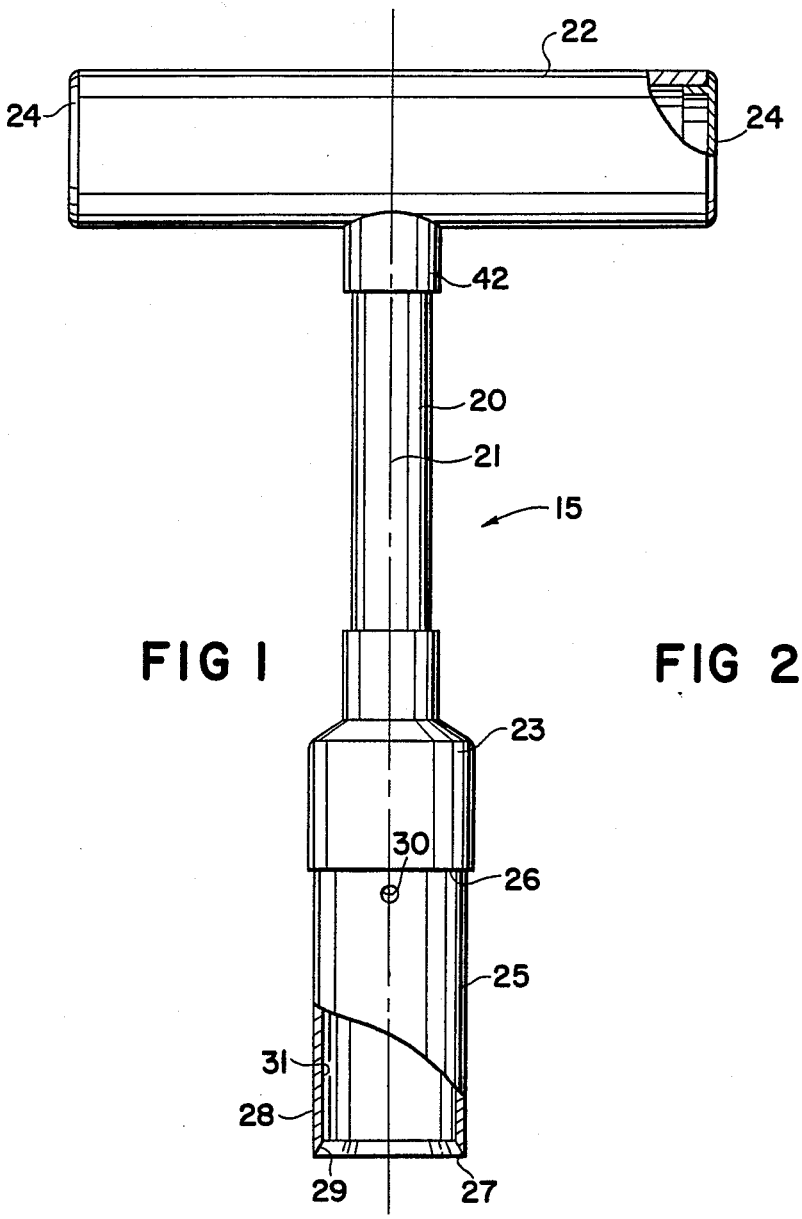
FIG. 1 is a front elevational view of the hand tool of this invention.
Figure 2:
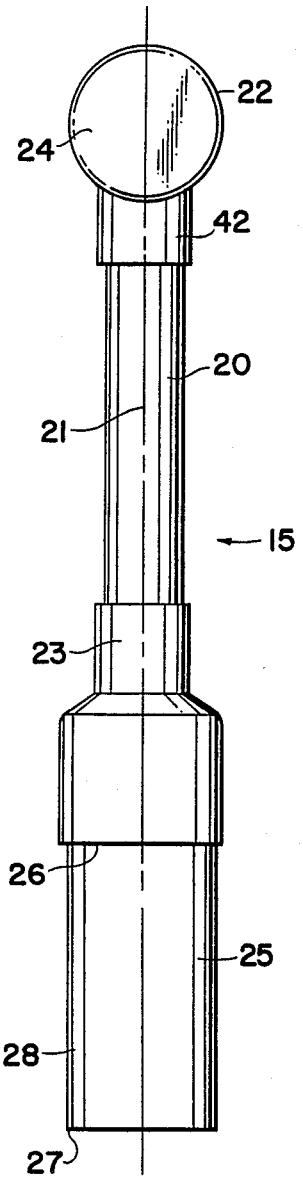
FIG. 2 is a side elevational view of the hand tool of this invention.

The tool according to the present invention is generally designated 15 in the drawings of FIGS. 1 and 2, and tool 15 includes a shaft-like body 20 with a handle 22 and an extractor member 25. Extractor member 25 is a thin cylindrical hollow tube which is rigidly attached to body 20 at one end 26 and the other end is sharpened into a circular dull knife edge 27, formed by the intersection of outside cylindrical wall or surface 28 and inside conical bevel surface 29. The inside cylindrical surface 31 of member 25 is of a predetermined diameter smaller than the external diameter of the insert. The bevelled surface 29 begins at surface 31 and tapers outwardly to dull knife edge 27 which is sharp to cut glue and the like but not to cut the user's hand during accidental contact. Outside surface 28 is substantially the same diameter as or slightly less than the diameter of the finger hole in the bowling ball.

Figure 3:
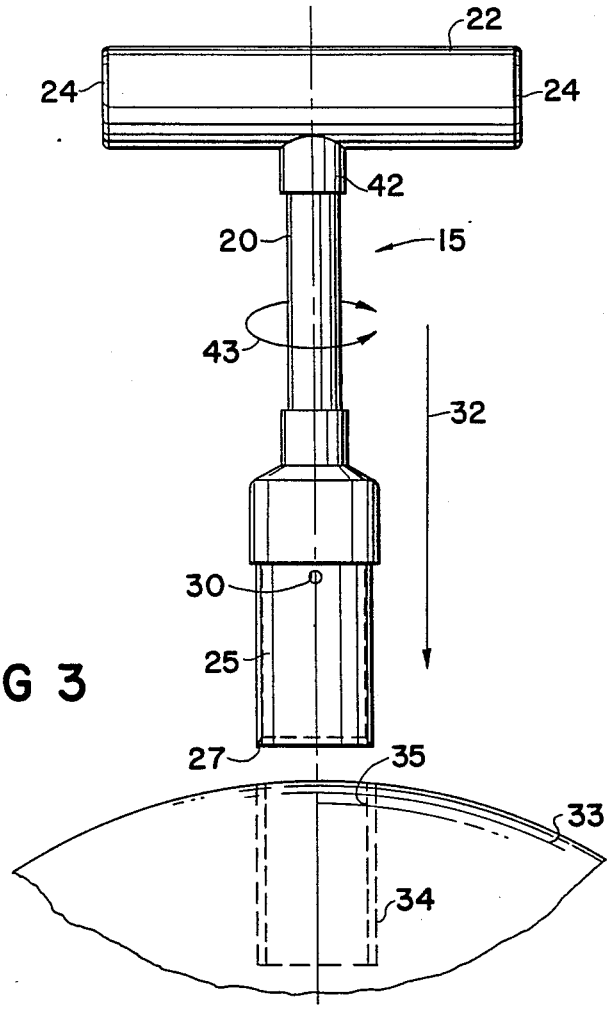
FIG. 3 is a general illustration of the manner of use of the hand tool of this invention to remove the finger grip insert.

In order to operate the tool the dull knife edge 27 is inserted into a finger hole 34 of a bowling ball 33 as shown in FIG. 3. Finger hole 34 is fitted with a finger grip insert 35 which is somewhat flexible and compressible, like rubber, and is glued into hole 34. As extractor 25 is moved into hole 34 in the direction of arrow 32 it is twisted around central longitudinal axis 21 in the direction of arrow 43 to cause knife edge 27 to cut the glue bond between ball 33 and insert 35.

The pushing and twisting of extractor 25 is accomplished by body 20 and handle 22. The simplest arrangement is that shown in the drawings to include a cross bar handle 22 attached to body 20 to produce a tee connection. Preferably all of these components are made from pipe stock, desirably copper pipe, including a tee section 22 with a side entrance 42, a straight nipple 20 attached to side entrance 42 and to a reducing coupling 23 with the larger portion of the coupling 23 attached to extractor tube 25. All connections are rigidly attached as by sweating or soldering. For convenience and smooth edges, pipe plugs 24 are fitted in each end of cross bar 22. Other shapes and arrangements may be employed in place of shaft member 20 and cross bar member 22, since all that is necessary is that the structure be able to hold extractor tubular member 25 and be turned and twisted about axis 21. Members 20 and 22 may be solid or tubular; round, square, or other shapes, or replaced entirely with another structure which will serve substantially the same purposes.

Since extractor member 25 is tubular and is closed at its upper end, an air vent is provided through the wall of extractor 25 so as to allow the escape of air when pushing extractor 25 into a finger hole of the bowling ball.

Sometimes finger hole 34 is not truly cylindrical, but is somewhat elliptical. In this event extractor tube 25 must be the same noncylindrical shape so as to fit hole 34. It, of course, is not possible to twist extractor 25 in a noncylindrical hole; only straight forward pushing can be employed. The principles according to this invention, however, would remain the same.

Figure 4:
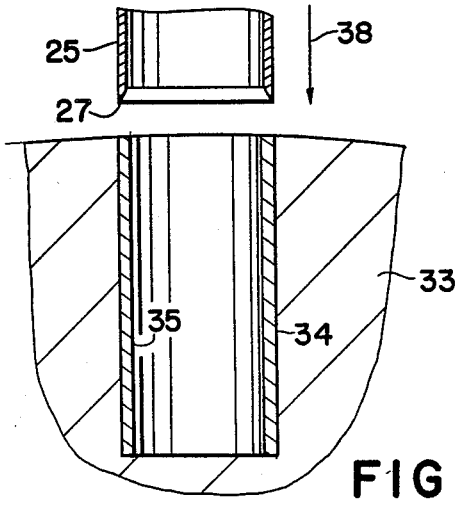
FIGS. 4–7 are schematic illustrations of the sequential specific steps in using the hand tool of this invention to remove a finger grip insert.
Figure 5:
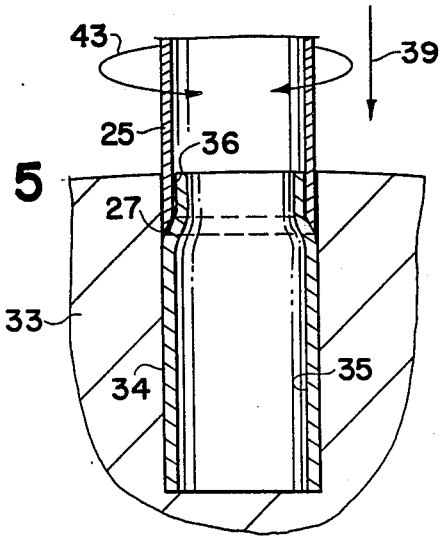
Figure 6:
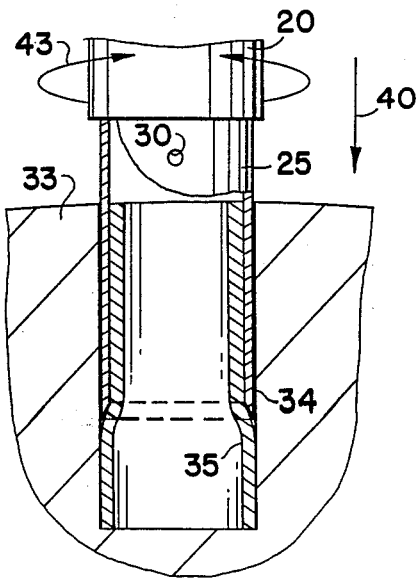
Figure 7:
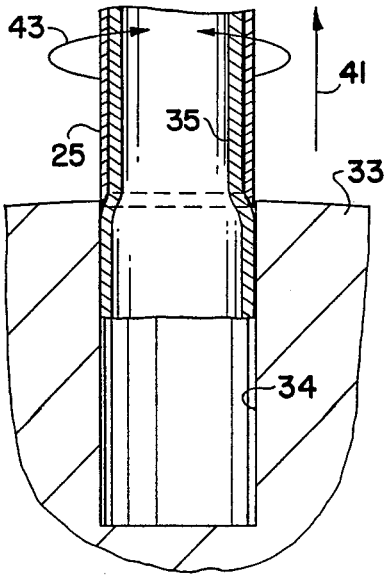

The operation of the hand tool of this invention is shown in FIGS. 3–7. A bowling ball 33 with a finger grip insert 35 in a finger hole 34 is shown with the hand tool 15 positioned above hole 34 ready to be inserted with circular dull knife edge 27 at the interface between insert 35 and hole 34. Tool 31 is pushed downward in the direction of arrow 32 and twisted in the direction of arrow 43 after being started into the interface. An enlargement of the position of extractor member 25 and bowling ball 33 is shown in FIG. 4 with the extractor being moved toward ball 33 in the direction of arrow 38. In FIG. 5 the knife edge 27 has entered into the interface between insert 35 and hole 34 causing the upper end of insert 35 to be squeezed or forcibly funneled into the hollow inside of extractor 25 as seen at 36. It may have been necessary to twist extractor 25 in the direction of arrow 43 while pushing forward in the direction of arrow 39. The wall 28 of extractor 25 is thin and the knife edge 27 is sharp, but not overly sharp, so as to cut through the glue bond between hole 34 and insert 35. In FIG. 6 the operation of pushing extractor member 25 forward in the direction of arrow 40 accomplished by twisting in the direction of arrow 43 is shown to have progressed until extractor 25 is about 75% of the way to the bottom of hole 34. Normally this is more than enough to free insert 35 from hole 34 because the glue bonding is usually limited to the top one-half of the interface between hole 34 and 35. Meanwhile insert 35 is pushed upward inside of extractor 25 without being materially damaged. In FIG. 7 extractor 25 is shown being withdrawn in the direction of arrow 41 from hole 34. Here again, it may be helpful to twist extractor in the direction of arrow 43 while pulling extractor 25 and insert 35 out of hole 34. After completely removing extractor 25 and insert 35 from hole 34, insert 35 may be pulled out of extractor 25 and cleaned up for reuse, if desired. One of the striking improvements of the tool according to this invention from those of the prior art is that the insert 35 can be removed without damage to it. The prior art devices inevitably tear up insert 35 and make it necessary to employ a new one each time insert 35 is removed.

It may be seen that another of the features of this invention is the provision of air vent 30. Prior art devices do not employ such a vent, with the result that air pressure is built up inside an extractor and insert 35 as the extractor is moved downwardly from a position corresponding to the position in FIG. 5 to that of FIG. 6. Such air pressure makes it very difficult to move the extractor member 25 downwardly and to separate the insert from the hole in the bowling ball. Air vent 30 relieves all of that pressure and permits easy and complete removal of insert 35 from hole 34 and while not being overly important, thereafter makes it easier to remove the insert 35 from the extractor member 25.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A tool for extracting a finger grip insert having a passageway therethrough for receiving a finger of a bowler and which has been glued in a finger cavity of a bowling ball which comprises a tool body with a hand grip adapted to turn said body about an axis and an insert extractor including an elongated thin tubular member having an external surface and an internal surface having opposite ends, one said end being rigidly connected to said body, another said end being a free end terminating in a substantially circular dull knife edge, said internal surface terminating short of said free end, said tubular member having an internal beveled surface extending between said internal surface and outwardly to said external surface at said tree end and forming said dull knife edge, said dull knife edge being sufficiently sharp to cut a glue bond between a finger grip insert and a finger cavity of a bowling ball, and said internal bevelled surface being adapted to forcibly funnel a finger grip insert into said tubular member during rotative cutting of a glue bond by said dull knife edge to inhibit damaging a finger grip during such cutting whereby a finger grip may be reused.

2. The tool of claim 1 which additionally includes an air vent through said tubular member adjacent said other end.

3. The tool of claim 1 wherein said tool body is formed as a shaft about which said tool is rotatable.

4. The tool of claim 3 wherein said hand grip is a lateral member extending outwardly from said shaft to form a T-shape tool for gripping of said lateral member on both sides of said shaft.

5. The tool of claim 1 wherein the outside diameter of said tubular member is substantially equal to an outside diameter of a finger grip insert.

6. A hand tool for extracting a flexible finger grip insert having a passageway therethrough for receiving a finger of a bowler and which has been glued in a finger cavity in a bowling ball, said tool including an elongated substantially cylindrical shaft member having opposite end portions and an extractor member affixed to one said end portion, a lateral cross bar handle extending on either side of said shaft adjacent another of said end portions, said extractor member including a hollow tubular member affixed at one end thereof to said shaft one end portion and another end being a substantially circular bevelled dull knife edge, said tubular member having a cylindrical internal surface and a cylindrical external surface and a tapering internal conical surface therebetween, said conical surface intersecting said internal surface of said tubular member spaced from said dull knife edge and extending laterally outwardly thereof to form said dull knife with said external surface.

7. The hand tool of claim 6 wherein said shaft member, said cross bar handle and said extractor member are portions of commercial copper pipe affixed together to form a T-shaped tool for gripping of said cross bar handle on both sides of said shaft member.

8. The hand tool of claim 6 wherein said hollow tubular member is a thin walled tube having an outer diameter substantially equal but less than a diameter of a cavity in a bowling ball with an insert therein.

9. The hand tool of claim 6 wherein said dull knife edge is sufficiently sharp to cut a glue bond between a finger grip insert and a cavity of a bowling ball and said conical surface being adapted to forcibly squeeze a finger grip insert into the hollow of said tubular member during rotative cutting of a glue bond by said dull knife edge without damaging an insert being extracted by said extractor member of said tool.

10. The hand tool of claim 6 which additionally includes an air vent communicating between said internal and external surfaces of said tubular member adjacent said one end thereof.

* * * * *